United States Patent [19]

Haraden et al.

[11] 4,219,870

[45] Aug. 26, 1980

[54] FRONT LOADING PROJECTION UNIT

[75] Inventors: Thomas Haraden, Ipswich; Harold L. Hough, Beverly, both of Mass.

[73] Assignee: GTE Sylvania Incorporated, Stamford, Conn.

[21] Appl. No.: 922,872

[22] Filed: Jul. 7, 1978

[51] Int. Cl.[2] ..... H01R 33/00

[52] U.S. Cl. ..... 362/226; 362/263; 362/306; 362/350; 362/396

[58] Field of Search ..... 362/226, 396, 306, 263, 362/350

[56] References Cited

U.S. PATENT DOCUMENTS

| | | | |
|---|---|---|---|
| 3,314,331 | 4/1967 | Wiley | 362/296 |
| 3,639,750 | 2/1972 | Maximiliaan | 362/226 |
| 3,789,212 | 1/1974 | Wagner | 362/306 |

*Primary Examiner*—Stephen J. Lechert, Jr.
*Attorney, Agent, or Firm*—Lawrence R. Fraley

[57] ABSTRACT

An improved projection unit which permits removal of the unit's lamp from the front, concave portion of the unit's reflector. A first retention member is used to maintain the lamp in pre-established alignment within the reflector and a second retention member, e.g. resilient clamp, is movably oriented on the reflector's neck portion to secure the first retention member in a first position and release it in a second.

11 Claims, 5 Drawing Figures

FRONT LOADING PROJECTION UNIT

CROSS REFERENCE TO COPENDING APPLICATIONS

An application entitled "Projection Unit Having Removable Retention Member" was filed Sept. 1, 1977 and is listed in the Patent and Trademark Office under Ser. No. 829,793 now U.S. Pat. No. 4,156,901, Ser. No. 829,793 is assigned to the same assignee as the present application and defines a projection unit which provides facile removal and replacement of the unit's lamp without requiring replacement of the unit's reflector component.

BACKGROUND OF THE INVENTION

The invention relates to incandescent lamp and glass reflector combinations for use in projection systems such as 16 mm. movie projectors.

In many projection units which include a preformed glass reflector and projection lamp, e.g. tungsten halogen, therein, the lamp is retained in alignment with the reflector by employing a suitable cement, e.g. sauereisen, within the reflector and about the lamp's sealed end. Examples of such arrangements are shown in U.S. Pat. Nos. 3,314,331 (Wiley) and 3,639,750 (Anthonijsz). Use of cement of a similar permanent-type bonding agent prohibits separation of the lamp and reflector in the event that replacement of either of these components is necessary. In almost all cases, it is only the incandescent lamp which fails and needs replacement. The aforementioned permanent bond between lamp and glass reflector was believed essential to assure precise alignment between said components and between these members and other elements (e.g. film gate, projection lens) within the overall system. Alignment between reflector and lamp was usually achieved using a precisioned instrument whereupon the assembled unit was ready for insertion within a respective socket-holder arrangement, such as shown in U.S. Pat. No. 3,789,212 (Wagner). This latter positioning is usually accomplished by the projector's operator.

Mandatory replacement of both lamp and glass reflector has therefore resulted in unnecessary waste of material which in turn has added appreciably to the overall cost of operating such systems.

The projection unit of Ser. No. 829,793 was designed to eliminate the above undesired requirement by providing a retention member which is removable from within the reflector yet also assures positive alignment of the unit's incandescent lamp with the reflector when said lamp is positioned therein. The retention member is secured to the lamp's sealed end and may comprise a metallic "can", a preformed component of insulative material such as ceramic, or a combination of both.

The present invention represents an improvement to the unit of Ser. No. 829,793 by providing means whereby the retention member having the sealed end of the lamp therein may be removed from the front, concave reflecting portion of the glass reflector. The method of removal for these components in Ser. No. 829,793 is through the rear, neck portion of the reflector. This requirement necessitates provision of a relatively large opening within the neck portion and, as a result, the lamp's total forward output is reduced. Rearward removal of the lamp is also somewhat difficult due to the limited accessibility of this portion of the unit within the overall system.

It can therefore be seen that a projection unit which permits forward removal of the unit's incandescent lamp from the glass reflector would constitute an advancement in the art.

OBJECTS AND SUMMARY OF THE INVENTION

It is therefore a primary object of the present invention to enhance the projection unit art by providing a projection unit which permits ready separation of the unit's projection lamp from the glass reflector through the front, concave reflecting portion of the reflector.

In accordance with one aspect of the invention, there is provided an improved projection unit which includes a glass reflector, an incandescent projection lamp, and a retention member which is removably oriented within the glass reflector and serves to maintain alignment of the lamp within the reflector. The improvement to the unit comprises providing means whereby the retention member, having the lamp retained therein, may be facilely removed from the reflector through the front, concave reflecting portion of said reflector.

DETAILED DESCRIPTION OF THE PREFERRED EMBODIMENT

For a better understanding of the present invention together with other and further objects, advantages and capabilities thereof, reference is made to the following disclosure and appended claims in connection with the above-described drawings.

Figure 1:
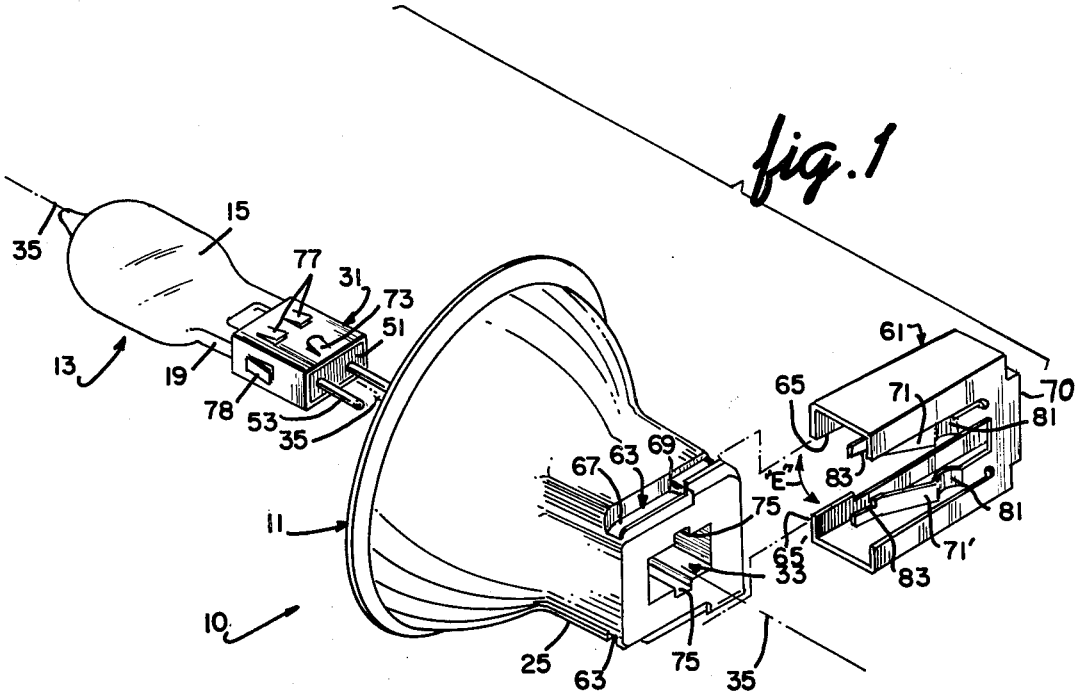
FIG. 1 is an exploded isometric view of a projection unit in accordance with a preferred embodiment of the invention.
Figure 2:
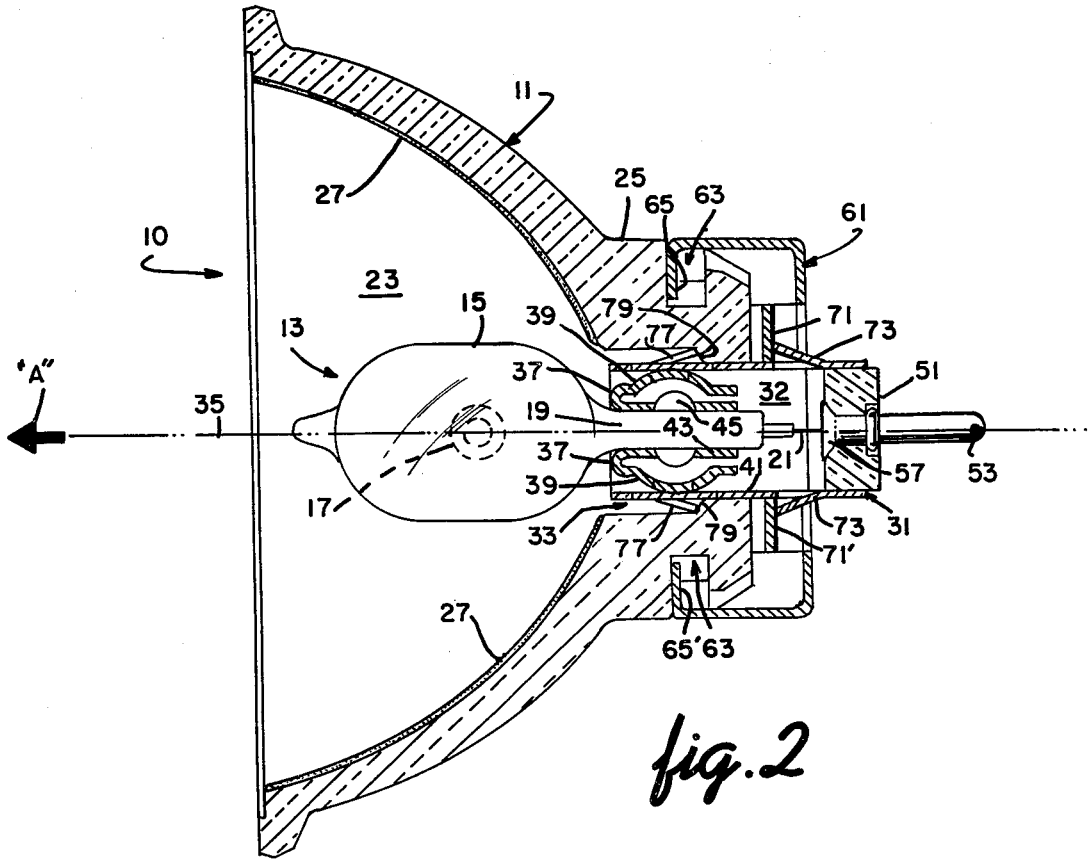
FIG. 2 is a side elevation view, partly in section, of the unit of FIG. 1 in the assembled position.
Figure 3:
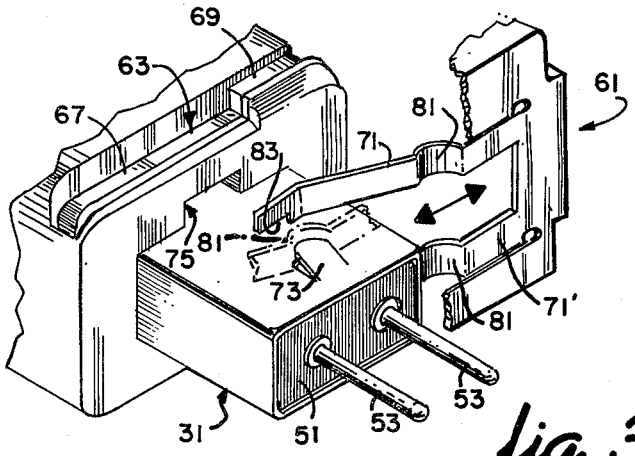
FIG. 3 is an isometric view of the unit of FIG. 2 showing the retaining and release positions of the second retention member of the invention.

In FIGS. 1–3 there is shown an improved projection unit 10 in accordance with one embodiment of the invention. As stated, unit 10 is particularly adapted for use within a projection system such as a 16 mm. movie projector. Accordingly, projection unit 10 would be located within a suitable socket-holder assembly (not shown) such as described and shown in the aforementioned U.S. Pat. No. 3,789,212. Projection unit 10 includes a glass reflector 11 and an incandescent projection lamp 13 adapted for being located within the reflector (FIG. 2). A preferred lamp 13 for use with the invention is one of the tungsten-halogen variety which produces 200 watts at a potential of 24 volts. Lamps of this type are known in the art and are typically rated for 50 hours of operation. Lamp 13 includes an envelope portion 15 having a tungsten filament structure 17 (FIG. 2) therein. The lamp further includes a press-sealed end portion 19 having a plurality (e.g. two) of electrical contact wires 21 extending therefrom. Usually, wires 21 are of molybdenum or similar conductive materials.

Reflector 11 includes a concave reflecting portion 23 and a hollow neck portion 25 adjacent thereto. Concave portion 23 is preferably elliptical and includes a thin dichroic internal layer or coating 27. Accordingly, reflector 11 permits much of the heat generated by lamp 13 to pass therethrough while still directing the lamp's visible output in a forward direction ("A") in FIG. 2.

As earlier stated, alignment between lamp 13 and reflector 11 is extremely critical in order to assure optimum forward output of unit 10. Understandably, alignment is also critical between unit 10 and the remaining elements of the overall projection system, such as the projector's film gate and projection lens. Such elements are well known in the prior art and are not illustrated here. To maintain said alignment between lamp 13 and reflector 11, a first retention member 31 is utilized and is secured to sealed end 19 of lamp 13. Member 31 preferably assures this securement by positively clamping the glass end, as shown fully in FIG. 2. The function of member 31 is to retain lamp 13 in alignment within reflector 11 such that the envelope is oriented within concave portion 23 of reflector 11 and the lamp's sealed end 19 is located substantially within neck 25. Member 31 defines an opening 32 therein in which is located sealed end 19 and extending wires 21 of lamp 13. Neck portion 25 also includes an opening 33 therein to accommodate member 31. Opening 33 is significantly smaller than the respective opening in the reflector of Ser. No. 829,793. This represents a substantial improvement over the unit described in Ser. No. 829,793 because a smaller opening understandably in an increase in total internal reflective area for concave portion 23 to in turn provide an increase in total forward (direction "A") light output for unit 10. In the embodiment of FIGS. 1–3, it is estimated that an increase of from about 10 to about 15 percent in forward output over the earlier unit will be provided. It is preferred that opening 33 is substantially rectangular, as shown, and that first retention member 31 is boxlike in configuration and thus readily adaptable for being located with the opening.

As a second improvement, it can be seen in FIG. 2 that a greater amount of glass material is provided at the location of juncture of concave portion 23 and neck 25, in comparison to the earlier unit. This added thickness serves to strengthen this portion of the reflector, thus facilitating handling and shipping of said member.

Lamp 13 is retained such that filament structure 17 lies on the central axis 35 of reflector 11 and in the focus of the ellipse of reflector 11. In accordance with one embodiment of the invention, this retained alignment is provided by using at least one clip member 37 (two are shown in FIG. 2). Clips 37, similar to those in Ser. No. 829,793, each include a domed portion 39 which engages the internal walls 41 of member 31. Domed portions 39, being metallic, are of sufficient thickness to assure a minor degree of resilience for clips 37. It is understood, however, that once projection unit 10 has been fully assembled, it is not possible to readily move (e.g. wobble) lamp 13 within the assembly. In other words, the present arrangement assures a positive degree of stiffness in order to maintain the required alignment between the lamp and reflector components. Portions 39 are preferably affixed (e.g. by welding) to walls 41. Each clip further includes a clamping segment 43 which clamps about end 19 in the manner shown. To facilitate this retention, end 19 includes a pair of opposing upstanding button portions 45 and each segment 43 includes an opening 47 to accommodate a respective button. Clips 37 are preferably oriented on end 19 in the overlapping positioning arrangement described in Ser. No. 829,793.

A ceramic member 51 is secured within an end portion of opening 32 and contains therein a pair of contact pins 53. Pins 53, one for each wire 21, are rigidly positioned within member 51 and are electrically joined to wires 21. It is preferred to stake contact pins 53 within member 51. In this case, the pins would be located and one end (57 in FIG. 1) staked. It may also be possible to form ceramic member 51 about the contact pins.

In the projection unit defined in Ser. No. 829,793, the projection lamp and retention member secured thereto were inserted into the unit's reflector through the reflector's neck portion. The method of insertion of the present invention represents a substantial improvement over this procedure by providing a means whereby insertion may be accomplished through concave portion 23. Removal is achieved simply by grasping the envelope 15 and pulling forward after completion of a minor step at the rear portion of the unit. This procedure involves movement of a second retention member 61 which is adapted for occupying first and second positions on neck portion 25 of reflector 11. In the first position (shown in phantom in FIG. 3), member 61 positively retains first member 31 within the predetermined alignment in reflector 11. When moved to a second position (shown in solid in FIG. 3), member 31 is released and permitted to be removed through concave portion 23.

Second retention member 61 is preferably a resilient clamp which is adapted for open expansion (in direction "E" in FIG. 1) to thus be removable from neck 25. To accommodate member 61, at least one slot 63 is provided in neck 25. Member 61 preferably comprises two opposing "jaw" portions 65, 65' which engage respective, opposing sides of neck 25. Accordingly, two slots 63 are provided, one for each jaw. Each slot includes an indented portion 67 in which one of the jaws slides after being located on neck 25. Understandably, the jaws are prohibited from sliding off neck 25 by the stepped part 69 of each slot, thus necessitating the described expansion of member 61 before removal thereof may be achieved. Member 61 is retained from sliding off neck 25 in the other direction by the end flange 70 of said member.

Clamp 61 includes a pair of extending, flexible arm members 71, 71' each of which is adapted for positively engaging a corresponding upstanding tab 73 located on first retention member 31. To accommodate member 31 and also facilitate alignment thereof, a corresponding pair of grooves 75 are provided within open portion 33 of neck 25, one of said grooves 75 adapted for having a respective one of said tabs 73 slidably oriented therein. It is understood of course that only one such tab is needed to secure positioning of member 31 and lamp 13 within reflector 11. Two are preferred, however, to provide positive securement on opposing sides of the first member. This securement is further enhanced by the provision of a pair of upstanding projection members 77 located on each side of first member 31 which includes one of said tabs 73 thereon. Each member 77 positively engages a step portion 79 (FIG. 2) within opening 33 of neck 25 when first retention member 31 is located therein. As shown in FIG. 1, two projections 77 are provided for each tab 73. Accordingly, four such members are preferred and a corresponding number of step portions similarly provided. Projections 77 are also offset on first retention member 31 from tab 73 with regard to central axis 35. Engagement of step portions 79 understandably prevents rearward movement of first member 31 beyond the desired aligned position shown in FIG. 2. Additional projection members 78 (FIG. 1) may be provided on the remaining sides of member 31 to further enhance alignment of said member within reflector 11.

With particular reference to FIG. 3, each arm 71, 71' of clamp 61 includes an indentation portion 81 therein which mates with a respective upstanding tab 73 when in the first, aligned position. Indentation portion 81 and the end of tab 73 possess similar curvatures to facilitate said engagement and securement. Removal of first member 31 is achieved by provision of a notched portion 83 within each arm 71, 71' such that tabs 73 may align with and pass thereunder when clamp 31 is in the second non-retaining position.

Figure 4:
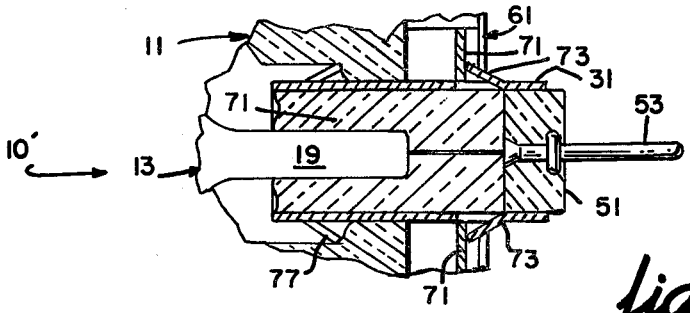
FIG. 4 is a partial side elevational view, partly in section, showing an alternate embodiment of the invention.

In FIG. 4 is shown a projection unit 10' in accordance with an alternate embodiment of the invention. Unit 10' comprises the same reflector 11, incandescent projection lamp 13, and first retention member 31 as the unit of FIGS. 1–3. Unit 10' differs from the previous example by the omission of clip members 37. Instead, the sealed end portion 19 of lamp 13 is rigidly secured within opening 32 of member 31 by a suitable ceramic cement 71 (e.g. sauereisen). Extending wires 21 are also located within cement 71 and are electrically connected directly to pins 53. A ceramic insulative member 51 is also used.

Figure 5:
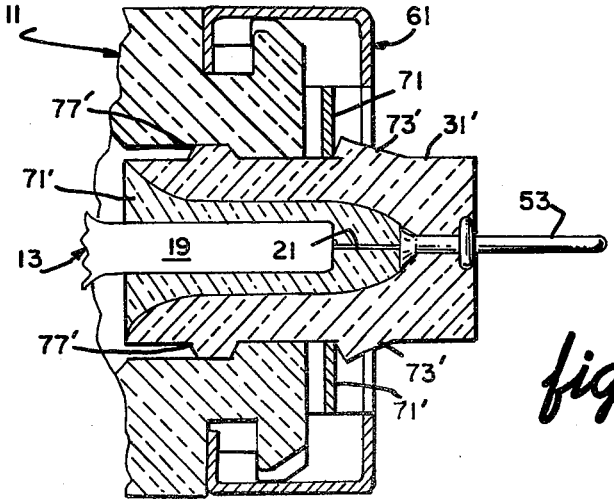
FIG. 5 is a partial side elevational view, partly in section, illustrating still another embodiment of the invention.

In the embodiment of FIG. 5, unit 10 utilizes an insulative, e.g. ceramic, first retention member 31' which includes upstanding portions 77' thereon which correspond and function in a similar manner to projection members 77 shown in FIGS. 1–4. Member 31' also includes upstanding portions 73' which correspond and function similarly to tabs 73 in the embodiments of FIGS. 1–4. Portions 73' and 77' align with and are oriented in respective grooves, etc. provided within opening 33' similarly to those in the aforedescribed embodiments. A suitable ceramic cement 71' is used to secure end 19 of lamp 13 in the required alignment. The extending wires 21 of lamp 13 are directly joined to pins 53.

Removal of the above first retention member 31 and lamp 13 secured therein is accomplished by a simple procedure wherein the unit's operator slidably moves clamp 61 to the described release position whereupon the operator can grasp the lamp's envelope portion 15 and effect forward removal. No twisting, rotation, or similar motion is required.

Thus there has been shown and described an improved projection unit which permits disassembly of the unit so that a defective lamp can be readily removed and replaced through the front of the unit's reflector. The invention assures that the critical alignment between lamp and reflector will be maintained despite continuous lamp insertion and removal.

While there have been shown and described what are at present considered the preferred embodiments of the invention, it will be obvious to those skilled in the art that various changes and modifications may be made therein without departing from the scope of the invention as defined by the appended claims.

What is claimed is:

1. In a projection unit including a glass reflector having a front concave reflecting portion and a neck portion adjacent thereto, an incandescent lamp including an envelope portion and a sealed end adjacent said envelope portion, and a first retention member removably oriented within said neck portion of said glass reflector for engaging and retaining said sealed end of said lamp therein to maintain said lamp in established alignment within said glass reflector whereby said envelope portion of said lamp will be located within said front concave portion of said reflector and said sealed end of said lamp will be located within said neck portion, the improvement wherein said first retention member having said sealed end of said lamp therein is removable through said front concave reflecting portion of said reflector.

2. The improvement according to claim 1 including a second retention member adapted for occupying first and second positions on said neck portion of said reflector, said second retention member retaining said first retention member within said aligned position within said reflector during said first position and permitting said removal of said first retention member and said lamp through said concave reflecting portion during said second position.

3. The improvement according to claim 2 wherein said first retention member includes at least one upstanding tab thereon, said second retention member engaging said tab to effect said retaining of said first retention member within said reflector during said first position.

4. The improvement according to claim 3 wherein said neck portion of said reflector includes at least one groove therein, said upstanding tab aligning with said groove during orientation of said first retention member within said neck portion of said reflector.

5. The improvement according to claim 3 wherein said neck portion of said reflector includes at least two stop portions therein and said first retention member further includes at least two upstanding projections located thereon in an opposing relationship to said upstanding tab, each of said projections aligning with and engaging a respective one of said stop portions when said first retention member is retained by said second retention member during said first position.

6. The improvement according to claim 3 wherein said second retention member includes at least one arm member, said arm member having an indentation therein for aligning with said upstanding tab on said first retention member during said first position.

7. The improvement according to claim 6 wherein said arm member includes a notched portion therein for aligning with said upstanding tab during said second position to permit said removal of said first retention member.

8. The improvement according to claim 6 wherein the number of said upstanding tabs is two and the number of said arm members of said second retention member is two, each of said arm members adapted for aligning with a respective one of said tabs.

9. The improvement according to claim 2 wherein said second retention member comprises a resilient clamp removably positioned on said neck portion of said reflector.

10. The improvement according to claim 9 wherein said neck portion includes at least one slot in the external surface thereof, said resilient clamp movably oriented within said slot during said occupancy of said first and second positions.

11. The improvement according to claim 1 wherein said neck portion of said reflector includes a rectangular opening therein, said first retention member of substantially boxlike configuration and adapted for being positioned within said rectangular opening.

* * * * *